US006354905B1

(12) United States Patent
Haines et al.

(10) Patent No.: US 6,354,905 B1
(45) Date of Patent: Mar. 12, 2002

(54) YO-YO HAVING ADJUSTABLE CLUTCH

(75) Inventors: C. Tyler Haines, Chagrin Falls; Gregory Cook, Garrettsville, both of OH (US)

(73) Assignee: Flambeau Products Corporation, Middlefield, OH (US)

( * ) Notice: Subject to any disclaimer, the term of this patent is extended or adjusted under 35 U.S.C. 154(b) by 0 days.

(21) Appl. No.: 09/500,331

(22) Filed: Feb. 8, 2000

(51) Int. Cl.[7] ..... A63H 1/30
(52) U.S. Cl. ..... 446/250
(58) Field of Search ..... 446/247, 250, 446/248, 249, 253

(56) References Cited

U.S. PATENT DOCUMENTS 4,332,102 A 6/1982 Caffrey
5,389,029 A * 2/1995 McAvoy, Jr. ..... 446/250
6,053,796 A * 4/2000 Tung ..... 446/250

* cited by examiner

*Primary Examiner*—Kien T. Nguyen
(74) *Attorney, Agent, or Firm*—Michael Best & Friedrich LLP

(57) ABSTRACT

A yo-yo includes an adjustable clutch mechanism having a pair of arms having flyweights mounted thereto and pivotally mounted within a cavity in one of the yo-yo halves. The arms include gear teeth that mesh with gear teeth on a movable member such that pivoting of the arms causes linear actuation of the movable member. The movable member includes engagement teeth that engage a spool. An adjuster mechanism includes a threaded bolt and a limiter threaded onto the bolt. The limiter is positioned by rotating the bolt. The position of the limiter determines the range of motion of the movable member.

6 Claims, 5 Drawing Sheets

YO-YO HAVING ADJUSTABLE CLUTCH

FIELD OF THE INVENTION

The invention relates to yo-yos, and more specifically to yo-yos having clutch mechanisms.

BACKGROUND

A yo-yo is said to sleep or dwell when the yo-yo spins at the end of the string, but does not climb up the string. String tricks are performed with yo-yos by first causing the yo-yo to sleep, then performing a maneuver, and then causing the yo-yo to "wake up" and climb back up the string. More intricate string tricks may be performed when the yo-yo sleeps longer, but the player must wake up the yo-yo before the yo-yo's speed drops too low. If the yo-yo's speed drops too low, the yo-yo will not be able to climb back up the string.

It is known to provide a clutch mechanism on a so-called "automatic return" yo-yo that couples and uncouples the yo-yo axle and body halves with a spool on which the string is selectively wound. The automatic return yo-yo ensures that the yo-yo will wake up before the yo-yo's speed drops too low.

For example, U.S. Pat. No. 4,332,102 discloses a yo-yo having a clutch mechanism including a pair of spring-biased flyweights pivotally mounted to one half of the yo-yo. An axle is fixed to each of the body halves, and rotatably supports a spool having a friction surface engaged by the flyweights. When the yo-yo rotates above a particular speed, referred to herein as the trigger speed, the flyweights pivot against the biasing force of the springs, releasing the spool for free rotation on the axle. When the yo-yo slows down to the trigger speed, the biasing force of the springs overcomes the centrifugal force acting on the flyweights, and the clutch again engages the friction surface of the spool to couple the spool with the axle and body halves, and wake up the yo-yo.

SUMMARY

The present invention provides a yo-yo having an adjustable clutch mechanism. The yo-yo includes first and second body halves, an axle extending between the body halves, a spool rotatably supported by the axle, a string interconnected with the spool, and an adjustable clutch mechanism on the first body half The adjustable clutch mechanism includes a movable body, a biasing member biasing the movable body into engagement with the spool, at least one flyweight interconnected with the movable body to cause said movable body to move out of engagement with said spool in response to the yo-yo rotating faster than the trigger speed, and an adjustment member adjusting the range of motion of the movable body with respect to the spool.

Other features and advantages of the invention will become apparent to those skilled in the art upon review of the following detailed description, claims, and drawings.

Figure 1:
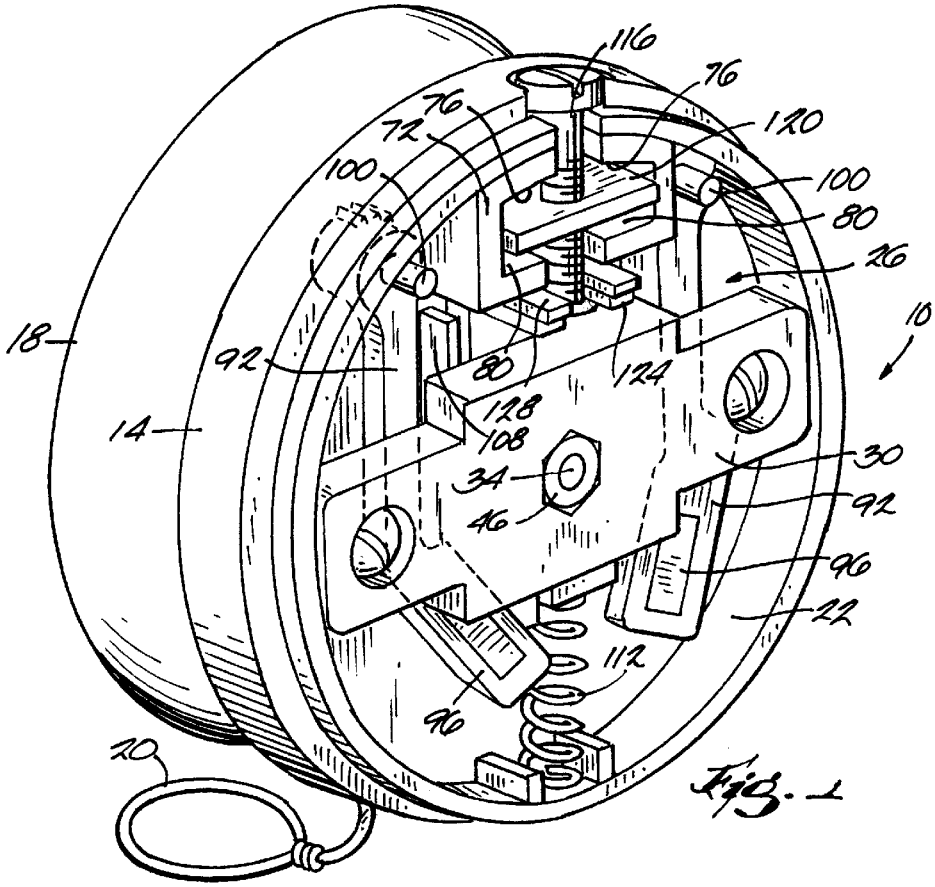
FIG. 1 is a perspective view of a yo-yo embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 illustrates a yo-yo 10 including first and second body halves 14, 18 and a string 20. The first body half 14 includes a cavity 22 housing a clutch mechanism 26, the details and function of which are discussed in further detail below. The clutch mechanism 26 is partially held in place within the cavity 22 by a cross member 30 fastened within the cavity 22, and by a lens or cover fixed over the cavity 22. The cover may be made of clear plastic to permit viewing of the clutch mechanism 26.

Figure 2:
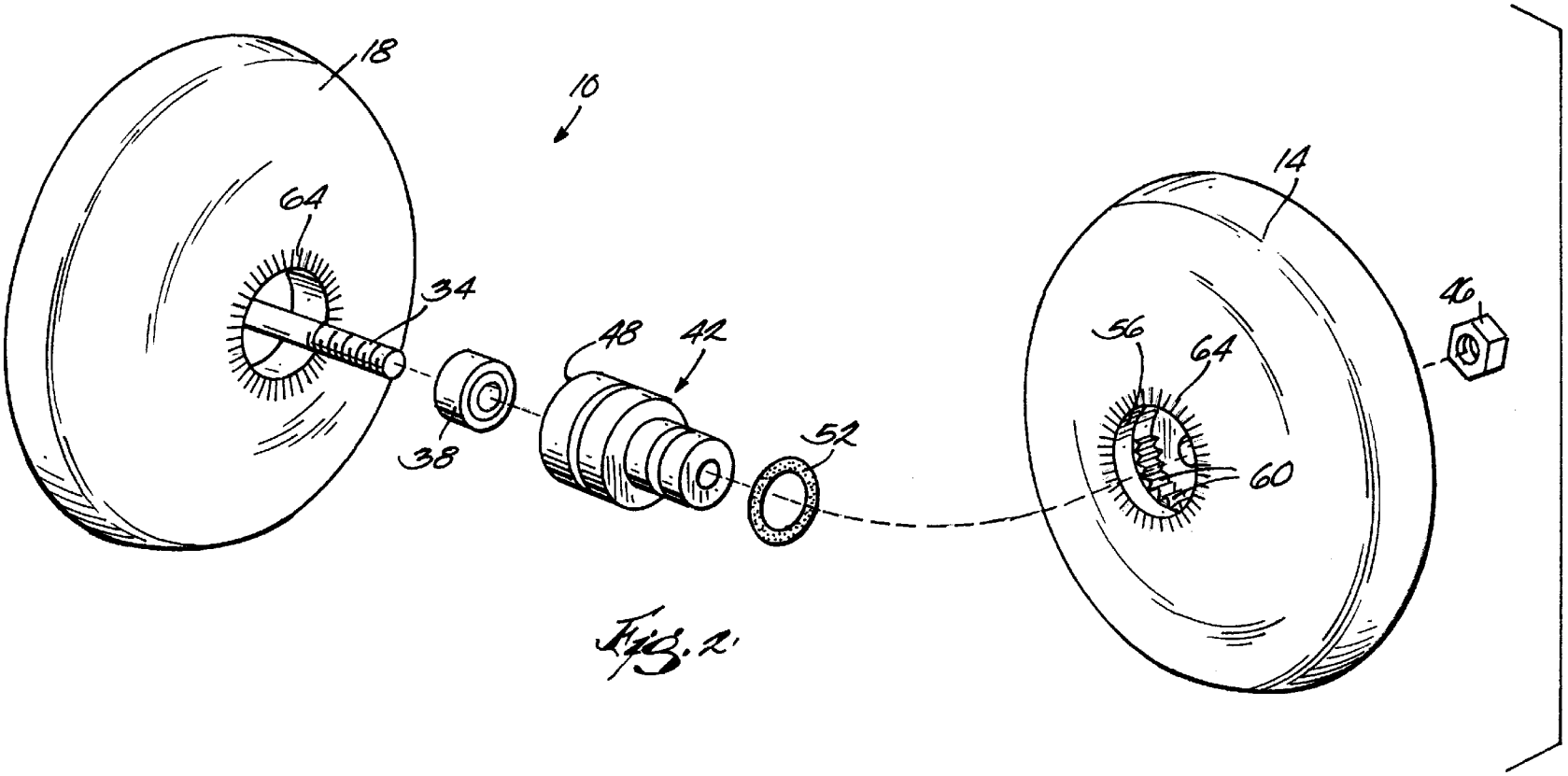
FIG. 2 is an exploded view of the yo-yo of FIG. 1.

As seen in FIG. 2, further components of the yo-yo 10 include an axle 34 having a threaded end, a bearing 38, a spool 42 to which the string 20 is attached, and a nut 46 threaded onto the threaded end of the axle 34 to rotationally fix the first and second body halves 14, 18 with respect to each other and with respect to the axle 34. As used herein, "rotationally fixed" means the parts are substantially prevented from rotating with respect to one another.

Still referring to FIG. 2, the bearing 38 and spool 42 are supported by the axle 34 for rotation on the axle 34. The bearing 38 includes inner and outer races. A first end 48 of the spool 42 abuts the outer race of the bearing 38 and the inner race is press-fit onto the axle 34. The second end of the spool 42 includes a friction surface 52. The illustrated friction surface 52 is a resilient o-ring or gasket made of rubber or another resilient material. The second end of the spool 42 extends into a recess 56 in the first body half 14, and is selectively engaged by engagement teeth 60 of the clutch mechanism 26 as further described below. The first and second body halves 14, 18 each have a raised star pattern 64 facing into the string gap, which pattern is known in the art to assist in waking up a yo-yo 10.

Figure 3:
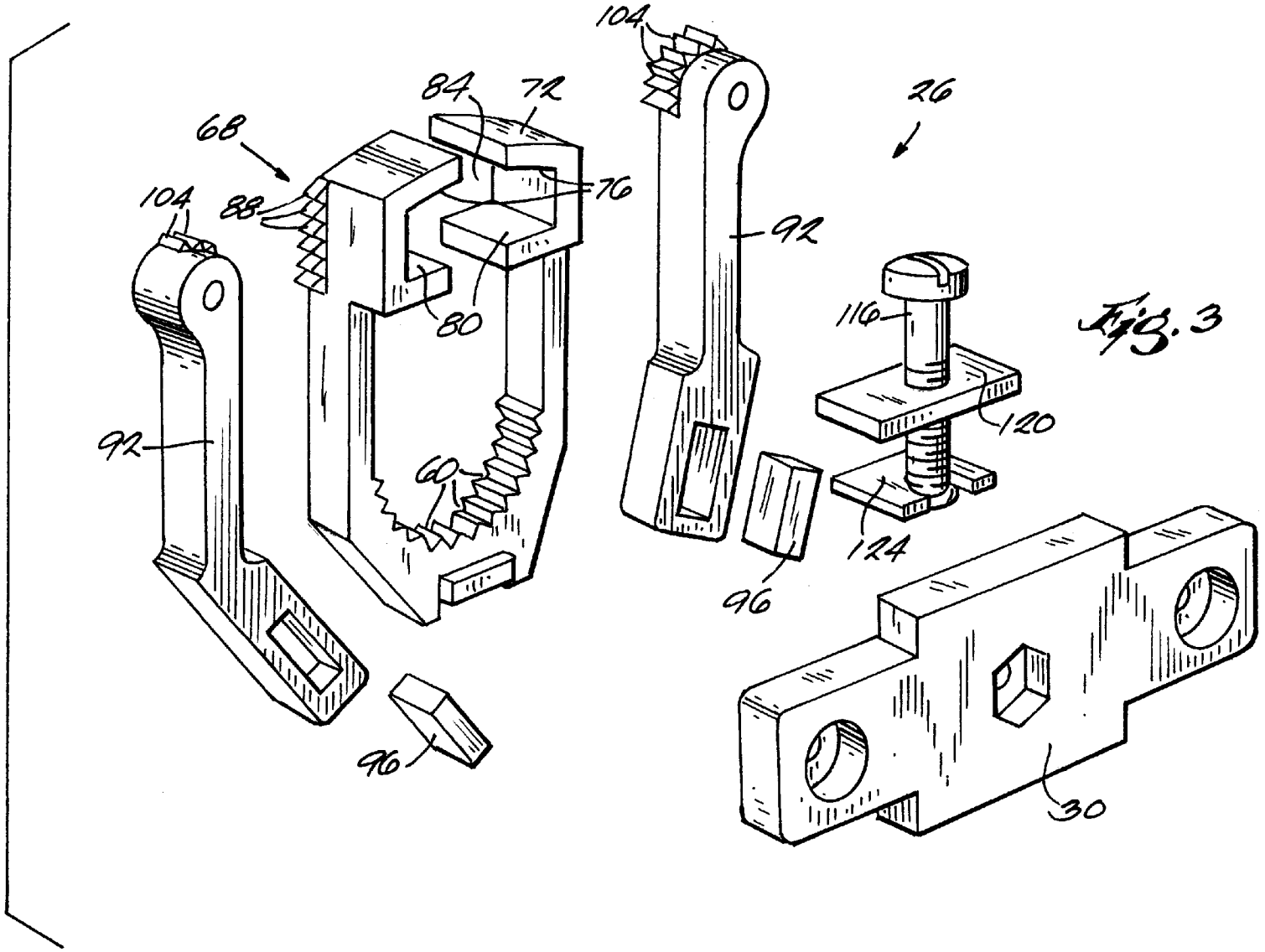
FIG. 3 is an enlarged exploded view of the clutch mechanism of the yo-yo illustrated in FIG. 1.

Referring now to FIG. 3, the clutch mechanism 26 includes a movable body 68 disposed around the recess 56 in the first body half 14 and including the aforementioned engagement teeth 60. Alternatively, the engagement teeth 60 may be replaced with a high-friction surface. The movable body 68 also includes a housing 72 having first and second split abutment surfaces 76, 80 defining a chamber 84 therebetween. The housing 72 has gear teeth 88 integrally formed on its outer surface. Alternatively, the gear teeth 88 may be replaced with a high-friction surface material. The movable body 68 is preferably made of plastic, but may be constructed of any suitable material.

The clutch mechanism 26 also includes a pair of arms 92 having flyweights 96 mounted thereto. The arms 92 are also preferably made of plastic, but may be constructed of any suitable material. Each arm 92 is pivotally mounted to the first body half 14 on a stub shaft or post 100 that is mounted to or formed integrally with the first body half 14. Each arm 92 includes gear teeth 104 that mesh with the movable body gear teeth 88 such that pivotal movement of the arms 92 causes axial movement of the movable body 68. Alternatively, the gear teeth 104 may be replaced with a high friction material. Guide members 108 formed integrally with or mounted to the first body half 14 further ensure that the movable body 68 slides in a substantially linear fashion. A spring or other biasing member 112 biases the movable member 68 toward a rest position (as seen in FIG. 4) in which the engagement teeth 60 engage the friction surface 52 of the spool 42 to rotationally fix the spool 42 with respect to the first body half 14 and the axle 34.

Still referring to FIG. 3, the clutch mechanism 26 includes an adjustment mechanism including a threaded bolt 116 having a head and a distal end, a limiter 120 threaded onto the bolt 116, and a retainer 124 mounted onto the distal end of the bolt 116. As is seen in FIGS. 1 and 4–7, the bolt 116 extends through the split first and second abutment surfaces 76, 80. The limiter 120 and retainer 124 are preferably made of very rigid plastic or a metal such as steel or aluminum, but may be made of any suitable material. A portion of the bolt's 116 threads may be removed at the distal end such that the retainer 124 is not rotationally fixed with respect to the bolt 116 and is not threadedly engaged by the bolt 116. Alternatively, as illustrated, the distal end of the bolt 116 may be mushroomed or crimped to prevent the retainer 124 from coming off the distal end of the bolt 116.

As seen in FIGS. 4–7 the limiter 120 is disposed within the housing 72 portion of the movable body 68. The width of the limiter 120 substantially spans the chamber 84 so that the limiter 120 will not rotate significantly within the housing 72, but may be moved axially along the bolt 116 within the housing 72 in response to rotation of the bolt 116. The retainer 124 abuts a fixed member 128 that is mounted to or integrally formed with the first body half 14. The retainer 124 prevents the bolt 116 from being threaded out of the yo-yo 10 so that rotation of the bolt 116 causes axial movement of the limiter 120 without moving the bolt 116. In other words, the bolt 116 is threaded only into the limiter 120.

Figure 4:
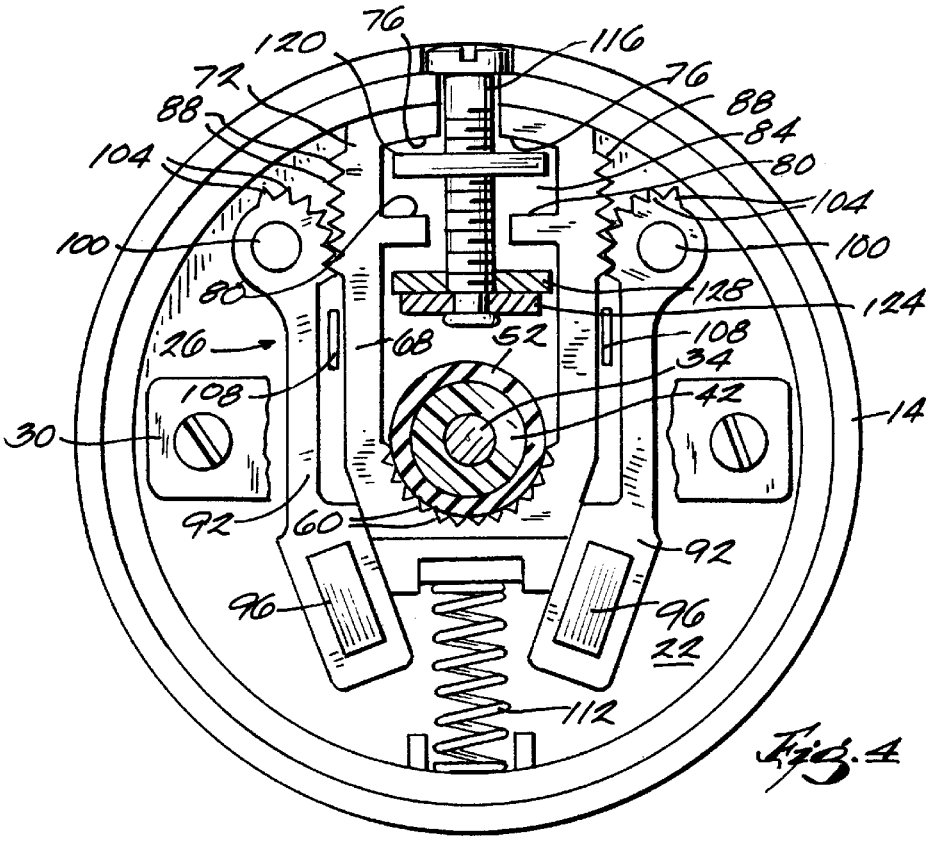
FIG. 4 is a side view of the yo-yo of FIG. 1 in an at-rest condition.
Figure 5:
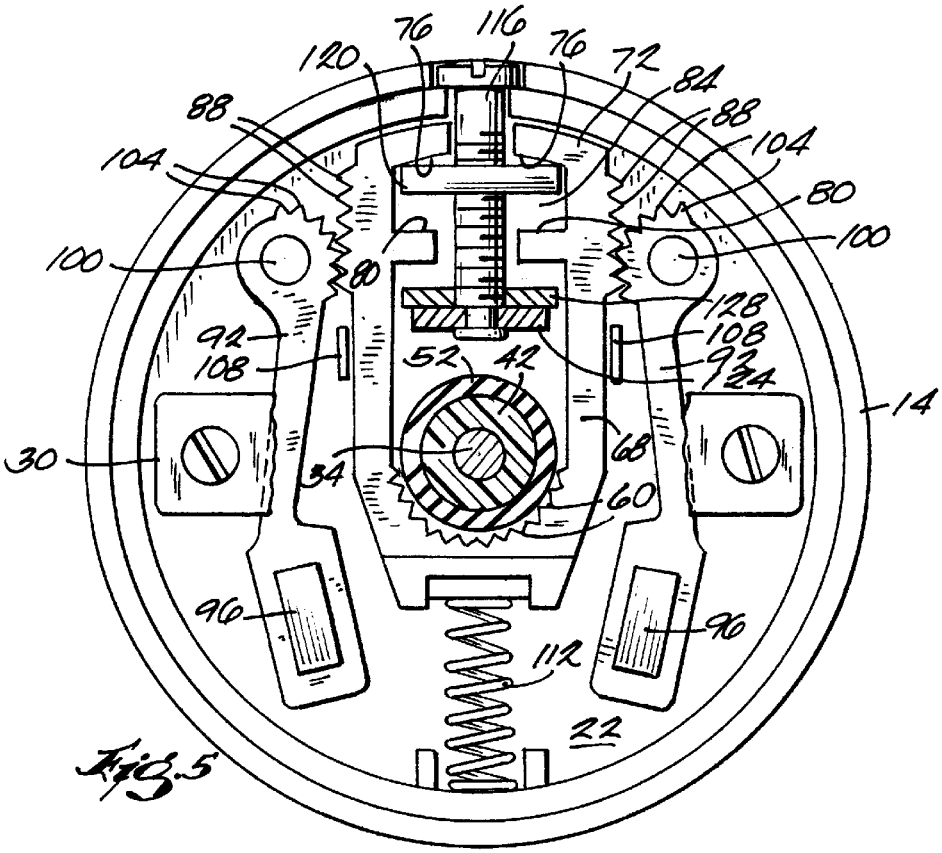
FIG. 5 is a side view of the yo-yo of FIG. 1 with the clutch in a disengaged position.

FIGS. 4 and 5 illustrate the yo-yo 10 at rest or spinning at or below the trigger speed, and the yo-yo 10 spinning above the trigger speed, respectively. In FIG. 4, the spring 112 provides enough biasing force to push the engagement teeth 60 of the movable body 68 into contact with the friction surface 52. In FIG. 5, when the yo-yo is spinning at a rate greater than the trigger speed, centrifugal force acting on the flyweights 96 causes the arms 92 to pivot out, thereby driving the engagement teeth 60 of the movable body 68 away from the friction surface 52. When the yo-yo 10 slows down to the trigger speed, the centrifugal force on the weights 96 and arms 92 is overcome by the biasing force of the spring 112, the arms 92 and movable body 68 return to the rest condition shown in FIG. 4, and the engagement teeth 60 engage the friction surface 52 of the spool 42 to couple the spool 42 with the body halves 14, 18 and axle 34.

The string 20 will wind on the spool 42 when the yo-yo is spinning at or below the trigger speed due to the clutch mechanism 26 engaging the spool 42. When the yo-yo 10 is spinning above the trigger speed, the spool 42 is free to rotate on the axle 34 with respect to the yo-yo halves 14, 18, and the string will not wind on the spool 42.

The maximum space between the engagement teeth 60 and the friction surface 52 is determined by the position of the limiter 120. When the movable body 68 moves far enough such that the first abutment surface 76 abuts the limiter 120 (see FIG. 5), further travel of the engagement teeth 60 away from the friction surface 52 is prevented. If the limiter 120 is positioned far enough away from the first abutment surface 76, the arms 92 may contact the walls of the cavity 22 before the limiter 120 stops movement of the movable body 68.

The closer the limiter 120 is positioned to the first abutment surface 76, the less the arms 92 are permitted to pivot, and the less the engagement teeth 60 of the movable member 68 are moved away from the friction surface 52 of the spool 42. Thus, the closer the limiter 120 is to the first abutment surface 76, the more sensitive the yo-yo 10 will be because the arms 92 and movable body 68 do not have to move very far to reach the rest condition. Very fine adjustments may be made to the clutch sensitivity by positioning the limiter 120 very close to the first abutment surface 76 such that the engagement teeth 60 do not totally disengage the friction surface 52, but still permit rotation of the spool 42. In this manner, the degree of friction between the engagement teeth 60 and the friction surface 52 may be finely controlled.

Figure 6:
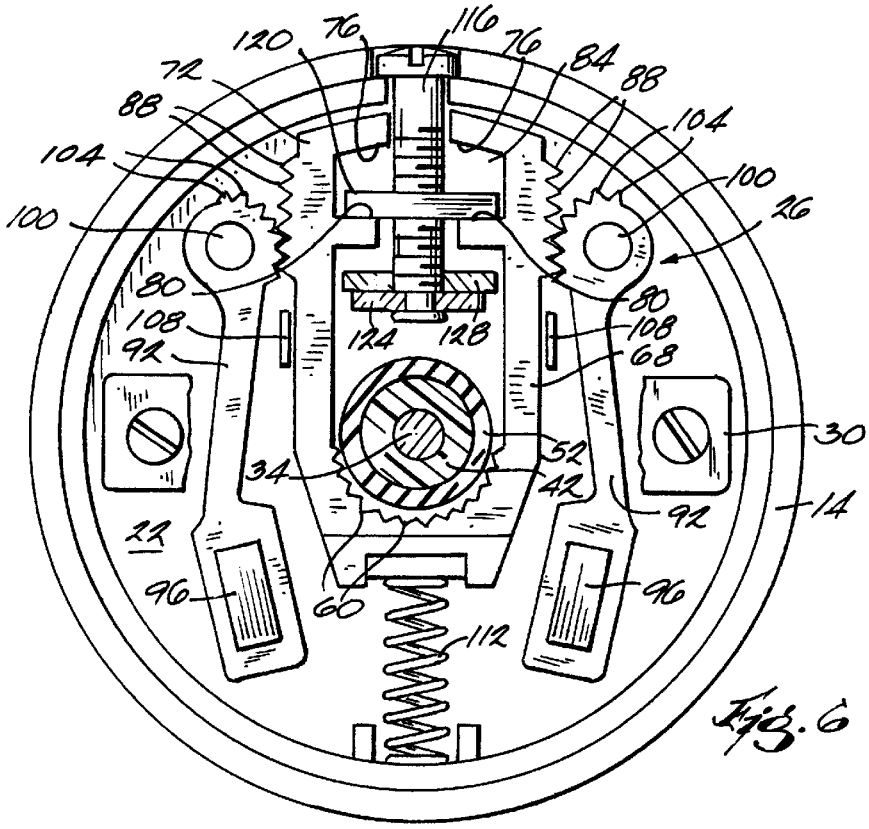
FIG. 6 is a side view of the yo-yo of FIG. 1 with the clutch in a fixed disengaged position.
Figure 7:
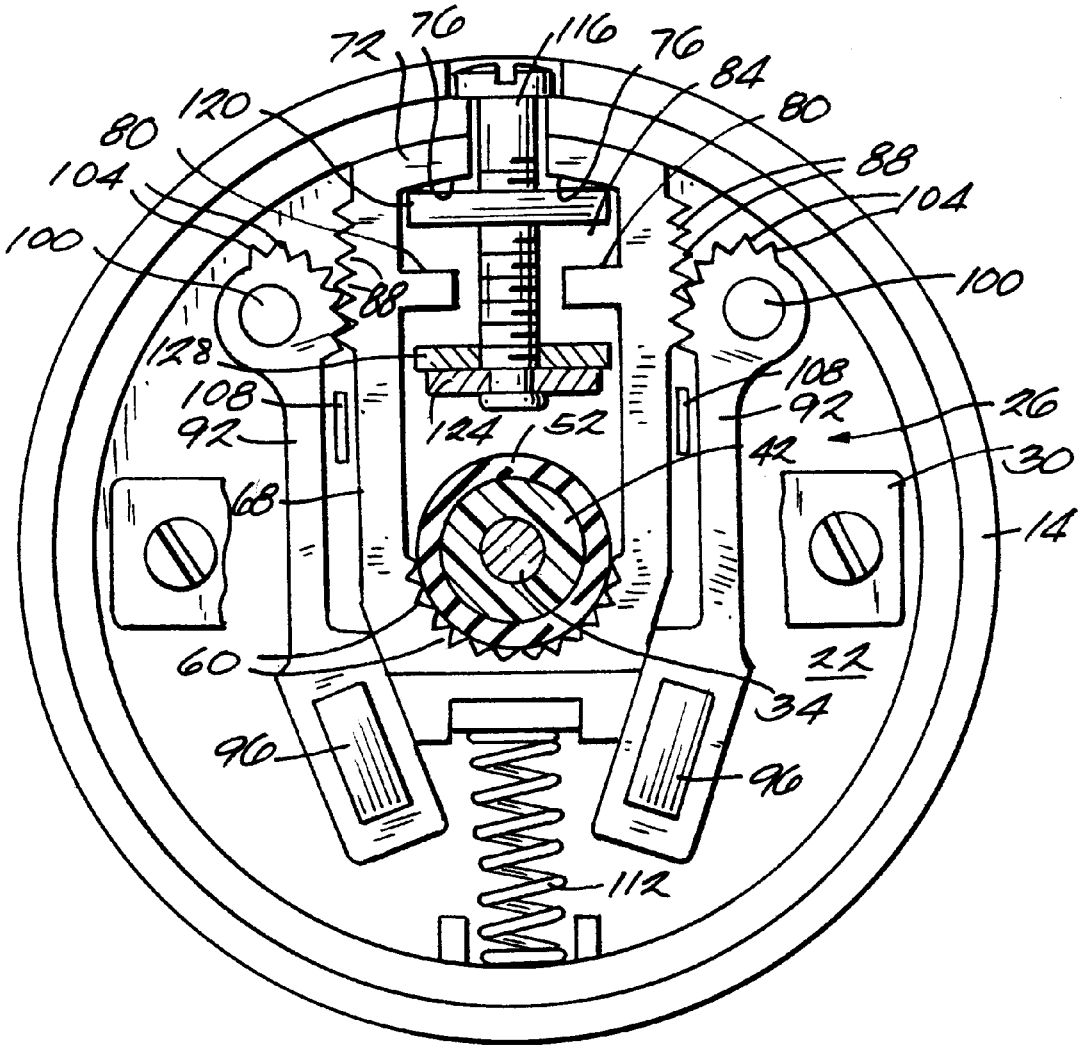
FIG. 7 is a side view of the yo-yo of FIG. 1 with the clutch in a fixed engaged position.

FIGS. 6 and 7 illustrate the clutch in a fixed disengaged and a fixed engaged condition, respectively. In FIG. 7, the adjustable clutch mechanism 26 is shown in a fixed engaged position in which the bolt 116 has been rotated to drive the limiter 120 against the first abutment surface 76 such that the arms 92 are not permitted to pivot. In this condition, the arms 92 are not able to move the movable body 68, and thus the engagement teeth 60 of the movable body 68 cannot disengage the spool 42. The spool 42 is thereby substantially coupled to the yo-yo halves 14, 18 and the axle 34, and the string 20 winds on the spool 42.

FIG. 6 illustrates the adjustable clutch mechanism 26 in a fixed disengaged position, in which the limiter 120 is driven against the second abutment surface 80 of the housing 72 to hold the engagement teeth 60 of the movable body 68 away from the friction surface 52 against the biasing force of the spring 112. In this condition, the spool 42 is disengaged and free to rotate on the axle 34.

What is claimed is:

1. A yo-yo comprising:

first and second body halves;

an axle extending between said body halves;

a string interconnected with said axle;

a clutch mechanism mounted to said first body half and including a movable body, a biasing member biasing said movable body into engagement with said axle, at least one flyweight interconnected with said movable body to cause said movable body to move out of engagement with said axle when said first body half rotates at a trigger rate of rotation, and an adjustment member adjusting the range of motion of said movable body with respect to said axle.

2. The yo-yo of claim 1, wherein said adjustment member is a screw.

3. The yo-yo of claim 1, wherein said movable body includes a first abutment portion, and wherein said adjustment member includes a second abutment member, whereby said adjustment member positions said second abutment member to abut against said first abutment member to limit movement of said movable body.

4. The yo-yo of claim 1, wherein said biasing member is a compression spring.

5. The yo-yo of claim 1, wherein said movable body includes a first toothed portion, and wherein said at least one flyweight includes an arm pivotally mounted to said first body half, a mass interconnected with said arm, and a second toothed portion interconnected with said arm and meshing with said first toothed portion, whereby centrifugal force acting on said mass causes said arm to pivot with respect to said first body half against the biasing force of said biasing member and causes said movable body to move due to said meshing engagement between said first and second toothed portions.

6. The yo-yo of claim 1, further comprising a resilient ring mounted on said axle, said movable body being biased by said biasing member to engage said resilient ring.

* * * * *